US009390867B1

(12) United States Patent
Baldwin et al.

(10) Patent No.: US 9,390,867 B1
(45) Date of Patent: Jul. 12, 2016

(54) TIMER ASSEMBLY WITH SLIM CONTACTS

(71) Applicant: Reliance Controls Corporation, Racine, WI (US)

(72) Inventors: Jeffrey P. Baldwin, Phoenix, AZ (US); John Klein, Gilbert, AZ (US); Ryan Liebengood, Gilbert, AZ (US)

(73) Assignee: Reliance Controls Corporation, Racine, WI (US)

( * ) Notice: Subject to any disclaimer, the term of this patent is extended or adjusted under 35 U.S.C. 154(b) by 209 days.

(21) Appl. No.: 14/049,650

(22) Filed: Oct. 9, 2013

Related U.S. Application Data

(60) Provisional application No. 61/711,961, filed on Oct. 10, 2012.

(51) Int. Cl.
*G04F 1/00* (2006.01)
*H01H 7/00* (2006.01)

(52) U.S. Cl.
CPC ..... *H01H 7/00* (2013.01)

(58) Field of Classification Search
CPC ..... H01H 7/00
USPC ..... 200/33 R, 38, 39
See application file for complete search history.

(56) References Cited

U.S. PATENT DOCUMENTS 2,688,366 A 9/1954 Morrison
2,898,993 A 8/1959 Huff
3,033,950 A 5/1962 Flegel
3,774,458 A * 11/1973 Kitai ..... G04F 3/06 200/38 A
3,866,002 A * 2/1975 Underwood ..... H01H 43/10 200/33 R
4,123,915 A * 11/1978 Stoor ..... H01H 43/10 200/38 B
4,311,886 A 1/1982 Rulseh
4,381,432 A * 4/1983 Cushing ..... H01H 43/125 200/19.15
4,524,252 A * 6/1985 Okazaki ..... G04F 3/06 200/38 E
4,766,331 A * 8/1988 Flegel ..... H01H 43/10 307/141
4,810,897 A 3/1989 Shotey
4,822,964 A 4/1989 Koch
4,853,558 A 8/1989 Skarivoda
5,266,841 A 11/1993 Flegel
5,329,082 A 7/1994 Saarem
5,637,843 A * 6/1997 Joyce ..... H01H 43/10 200/38 B
5,747,760 A * 5/1998 Skarivoda ..... H01H 43/101 200/37 R
D408,303 S 4/1999 Janda et al.
D409,505 S 5/1999 Janda et al.
5,910,649 A * 6/1999 Amonett ..... H01H 43/10 200/38 B
D430,497 S 9/2000 Michaels
D500,453 S 1/2005 Cullen et al.
7,005,589 B2 * 2/2006 Amonett ..... H01H 43/106 200/38 B
8,415,573 B2 4/2013 Lipp et al.
8,882,343 B1 * 11/2014 Baldwin ..... G04B 19/30 368/10

* cited by examiner

*Primary Examiner* — Kyung Lee
(74) *Attorney, Agent, or Firm* — Boyle Fredrickson, S.C.

(57) ABSTRACT

A timer is configured with an electrical contact assembly with a thin construction, which provides a thinner and more compact timer assembly. In particular a thinner and more compact timer assembly is achieved by implementing various features of the present invention, including but not limited to, recessed contact arm channels, contact arms positioned wholly on a single side, contact arms oriented with a length parallel to the baseplate and a thickness parallel with the baseplate thickness, and a slim profile actuator which moves in the direction of the length.

24 Claims, 9 Drawing Sheets

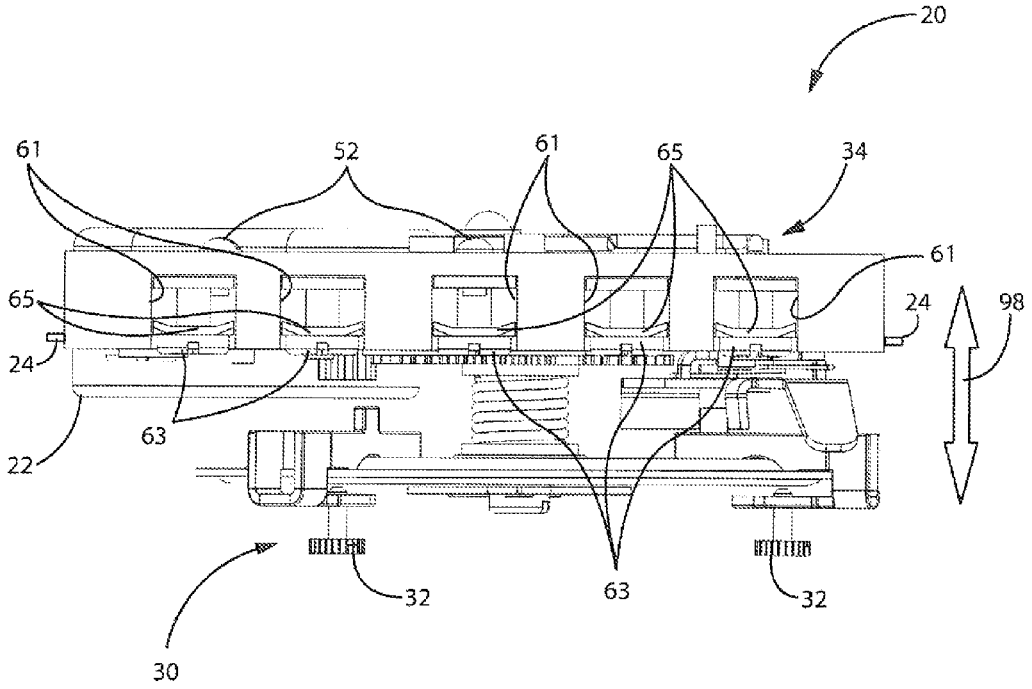
FIG. 3
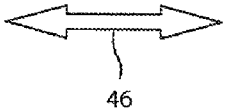

TIMER ASSEMBLY WITH SLIM CONTACTS

CROSS-REFERENCE TO RELATED APPLICATIONS

This application claims priority to U.S. provisional application Ser. No. 61/711,961, filed Oct. 10, 2012, the entire contents of which is incorporated herein by reference.

BACKGROUND OF THE INVENTION

1. Technical Field

The present invention relates generally to a timer used in commercial, industrial and residential applications, and more particularly, pertains to a timer with slim contact assemblies providing slim construction for the timer.

2. Background Art

Timers are used for a variety of applications and purposes throughout commercial, industrial and residential buildings. Timers provide automated and adjustable control of electrical devices without having to be physically present to operate the device. Timers may be used, for example, to control pools, water heaters, lights, or any other suitable electrical component. The timers may be electrically controlled or mechanically controlled, with the mechanical variety having several trippers which operate to turn on and off the electrical component at the desired time. Since a timer is adjustable, the control mechanisms must be accessible from wherever the timer is mounted. The timer enclosures are generally mounted to a wall, post or other structure nearby the electrical device they are meant to control. The overall appearance and dimensions of timers vary greatly depending on the components utilized.

The present invention seeks to improve upon the prior art by providing a timer having electrical contact assemblies with a thin construction which provide a thinner and more compact timer assembly.

SUMMARY OF THE INVENTION

The present invention is generally directed to a timer wherein compact electrical contacts allow for a compact configuration of the timer. In particular, a thinner and more compact timer assembly is achieved by implementing various features of the present invention, including but not limited to, recessed contact arm channels, contact arms positioned wholly on a single side, contact arms oriented with a length parallel to the baseplate and a thickness parallel with the baseplate thickness, and a slim profile actuator which moves in the direction of the length.

In one embodiment, a timer assembly includes a baseplate having a front side and a back side, a time indicator extending from the front side of the baseplate, an electrical contact assembly having at least one contact arm having a length longer than its width and thickness and a first contact on the at least one contact arm, and a second contact selectively separable from the first contact, wherein the at least one contact arm length is oriented generally parallel with the baseplate back side.

In one aspect, the timer assembly may further include a second contact arm having a length longer than its width and thickness and a third contact on the second contact arm. The timer assembly may further include a fourth contact selectively separable from the third contact. The first and second contacts may be in electrical continuity when an actuator is in a first position and are not in electrical continuity when the actuator is in a second position.

In another aspect, the timer assembly may further include an actuator for selectively connecting and disconnecting the first and second contacts. The actuator may be moveable in a direction parallel with the length of the at least one contact arm. The actuator may bias one of the first and second contacts in a direction parallel to the at least one contact arm thickness.

In another aspect, the at least one contact arm may further include an angled step and the actuator may move the at least one contact arm at the angled step.

In another aspect, the timer assembly may further include a protrusion extending from the electrical contact assembly, wherein the actuator movement is limited by the protrusion.

In another aspect, the actuator may move to a left side and a right side of the baseplate.

In another aspect, the at least one contact arm may further include a threaded portion opposite the first contact for receiving a screw. The screw may carry an electrical current therethrough.

In another aspect, the at least one contact arm may further include an alignment opening adjacent the threaded portion. The alignment opening may be received on the electrical contact assembly.

In another aspect, the actuator may further include a pair of ramps, wherein the at least one connecting arm is positioned between the pair of ramps. One of the pair of ramps may bias the at least one connecting arm in a first direction. The other of the pair of ramps may bias the at least one connecting arm in a second direction opposite the first direction.

In another aspect, the timer assembly may transmit an electrical phase selected from the group consisting of single phase, two-phase, and three phase.

In another embodiment, a timer assembly includes a baseplate having a front side and a back side, a time indicator extending from the front side, an electrical contact assembly having a first contact arm having a length longer than its width and thickness and a first contact on the first contact arm, a second contact arm having a length longer than its width and thickness and a second contact on the second contact arm, a third contact arm having a third contact, and a fourth contact arm having a fourth contact, wherein the first contact selectively engages the third contact and the second contact selectively engages the fourth contact.

In one aspect, the timer assembly may further include an actuator that is movable to selectively disconnect the first and third contacts and the second and fourth contacts. The actuator may be movable in a direction parallel to the first and second contact arm lengths. The actuator may move the first and third contacts in a direction perpendicular to the direction of actuator movement.

In another aspect, the first and second contact arms may each further include an angled step, and the actuator contacts the angled steps.

In another aspect, the actuator further comprises a pair of ramps for biasing the first and second contact arms. One of the pair of ramps may bias the first and second contact arms in a first direction and the other of the pair of ramps may bias the first and second contact arms in a second direction.

In another aspect, the first and second contact arms may each further include a threaded portion arranged to receive electrical current therein.

In another aspect, the first and second contact arms may not extend to the front side of the baseplate.

Various other features, objects and advantages of the present invention will be apparent from the following detailed description taken together with the drawings.

BRIEF DESCRIPTION OF THE DRAWINGS

The drawings illustrate the best mode presently contemplated for carrying out the invention.

In the drawings:

FIG. 3 is a bottom plan view of the timer assembly of FIG. 1 with the electrical contact assembly in the open position;

DETAILED DESCRIPTION OF THE DRAWINGS

Figure 1:
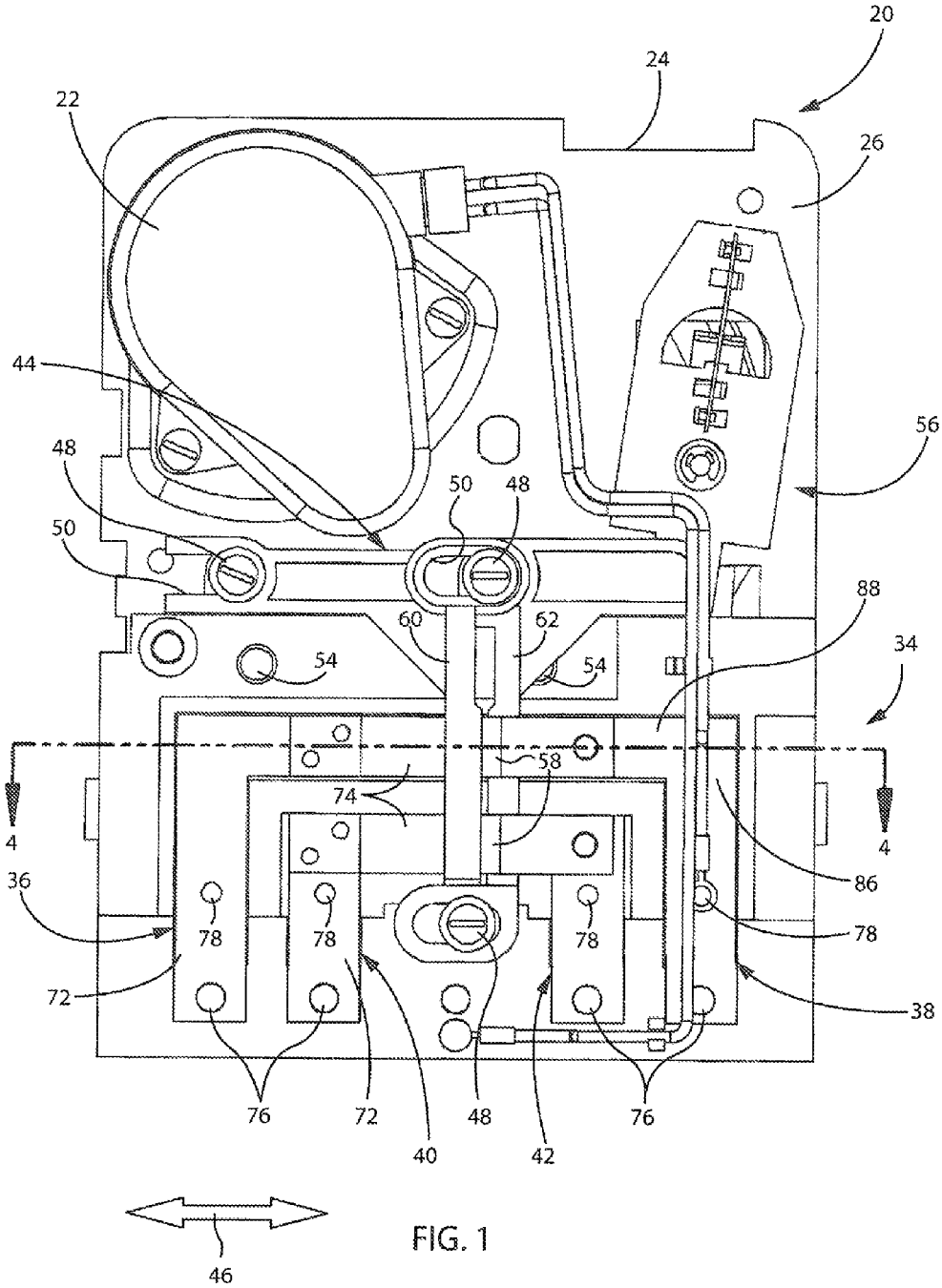
FIG. 1 is a rear elevation view of a timer assembly with an electrical contact assembly in accordance with the present invention attached to a baseplate of the timer assembly and in an open position.

This invention relates to a timer assembly having an electrical contact assembly with a compact arrangement to minimize the length, thickness, and width of the tuner assembly.

FIGS. 1 through 4 illustrate various views of a timer assembly 20 in accordance with the present invention. A baseplate 24 of the timer assembly 20 includes a front side 28 and an opposite back side 26. A time indicator 30 is positioned so as to extend outward from the base plate front side 28 and may include a number of timer triggers 32 for activating a connected device (not shown). Although a mechanical time indicator 30 is shown and described, a digital or other suitable time indicator may be utilized. A motor 22 is positioned on the baseplate 24, in particular on the back side 26 of the baseplate 24, to operate the time indicator 30. An electrical contact assembly 34 is also positioned on the baseplate 24 such that a back side of the electrical contact assembly 34 is exposed from the back side 26 of the baseplate 24.

Referring specifically to FIG. 1, the electrical contact assembly 34 is shown positioned on the back side 26 of the baseplate 24. The electrical contact assembly 34 may include a first contact arm 36 arranged for selective electrical contact with a third contact arm 38. The electrical contact assembly 34 may also include a second contact arm 40 arranged for selective electrical contact with a fourth contact arm 42.

Figure 5:
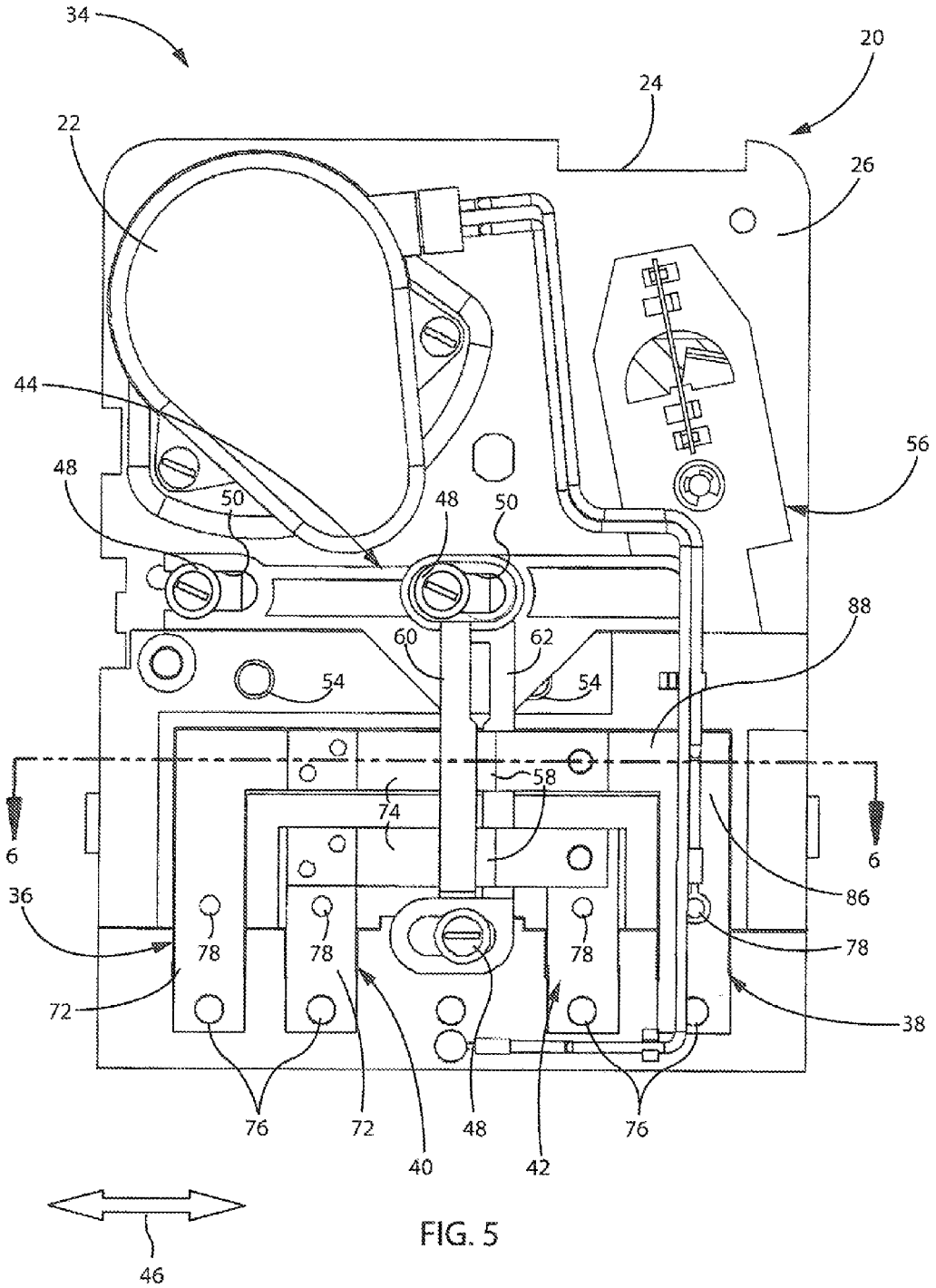
FIG. 5 is a rear elevation view of the timer assembly of FIG. 1 with the electrical contact assembly in a closed position.

The contact assembly 34 further includes an actuator 44 that provides movement in the directions associated with arrow 46 to engage and disengage the respective contact arms 36, 38, 40, 42 as may be appropriate and will be described in greater detail below. The actuator 44 slides in the directions associated with arrow 46 and movement is limited by mounting screws 48. Specifically, the actuator 44 includes a series of alignment slots 50 arranged to orient the movement of the actuator 44 as well as limit the travel of the actuator 44 in any one direction. For example, when the actuator 44 moves all the way to the left to disengage the respective electrical contact arms, the right side of the alignment slots 50 contacts the mounting screws 48 to limit travel of the actuator 44, as seen in FIG. 1. In a similar fashion, when the actuator moves all the way to the right to engage the respective electrical contact arms, the left side of the alignment slots 50 contacts the mounting screws 48 to limit travel of the actuator 44, as seen in FIG. 5.

Figure 2:
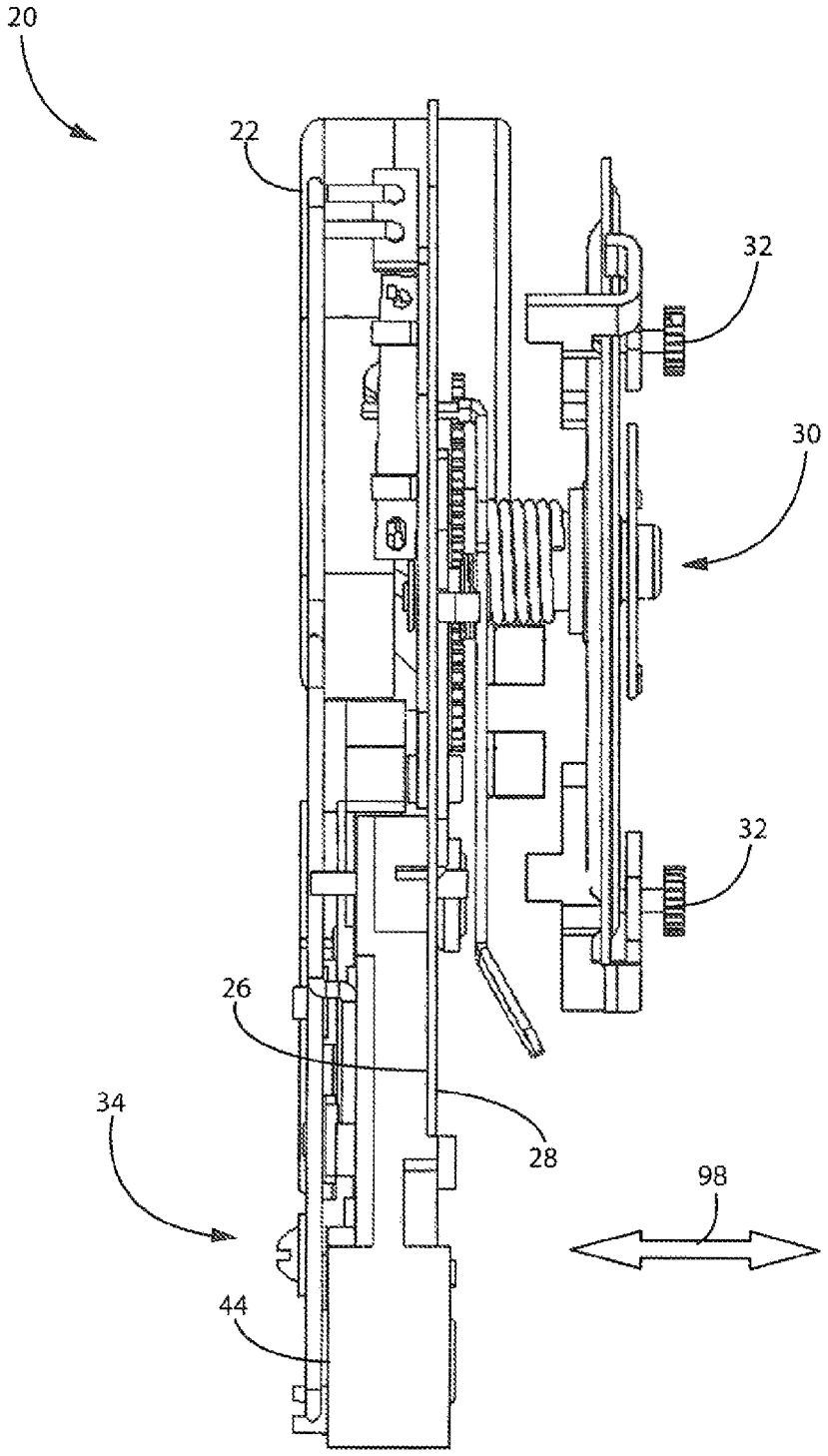
FIG. 2 is a side elevation view of the timer assembly of FIG. 1 with the electrical contact assembly in the open position.

Referring now to FIGS. 1 through 3, it is seen that the electrical contact assembly 34 is secured to the baseplate 24 with screws 52 through apertures 54 in the electrical contact assembly 34. Advantageously, this arrangement allows the electrical contact assembly 34 to be a modular unit which can be replaced if components are broken or damaged. Alternatively, the electrical contact assembly 34 may be secured to the baseplate 24 with rivets or any other suitable securing arrangement. The electrical contact assembly 34, and specifically a spring biased engagement member 56, is rotated to contact the actuator 44 as will be discussed in greater detail below. However, it should be noted that the actuator 44 may be biased in a direction against the spring biased engagement member 56 such that both the electrical contacts and the actuator can be moved to an engaged or disengaged position based on the movement of the spring biased engagement member 56.

As best seen in FIG. 3, a series of wiring apertures 61 are shown with wiring washers 65 and wiring screws 63. The wiring apertures 61 are arranged to receive both the main wiring leads in certain wiring apertures and selectively feed electrical power to a connected device when the timer assembly 20 is turned on as is known in the art. The wiring apertures 61, the washers 65, and the wirings screws 63 also provide electrical power to the motor 22 for timing purposes and to the various contact arms 36, 38, 40, 42 for selectively providing power to the connected device.

Figure 4:
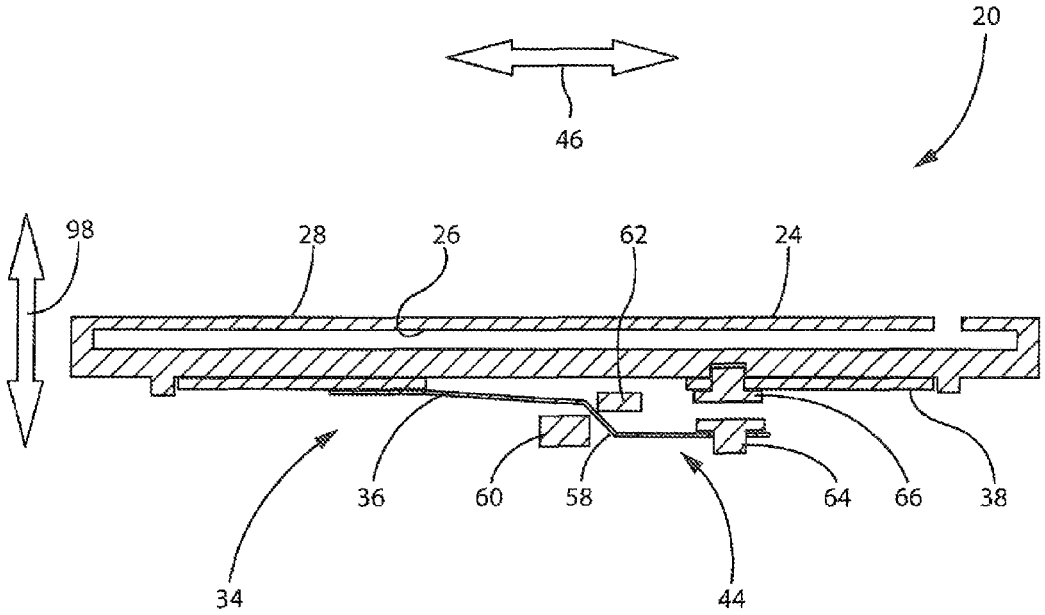
FIG. 4 is a top section view taken generally along line 4-4 in FIG. 1 with the electrical contact assembly in the open position.

FIG. 4 illustrates a top sectional view of the baseplate 24 and the electrical contact assembly 34 with the first contact arm 36 and the third contact arm 38 also shown. As can be seen, the first contact arm 36 may include an angled step 58, with the angled step 58 being located between a first ramp 60 and a second ramp 62 both formed as part of the actuator 44, as will be described in greater detail below. Further, the first contact arm 36 includes an electrical contact 64, while the third contact arm 38 includes an electrical contact 66 which will also be described in greater detail below. In operation, the actuator 44 moves in the direction associated with arrow 46 so that the respective ramps (60 or 62) of the actuator 44 contact the angled step 58 of the first contact arm 36 to move the first contact arm 36 and the electrical contact 64 towards the electrical contact 66 or away from the electrical contact 66, as is shown.

Figure 6:
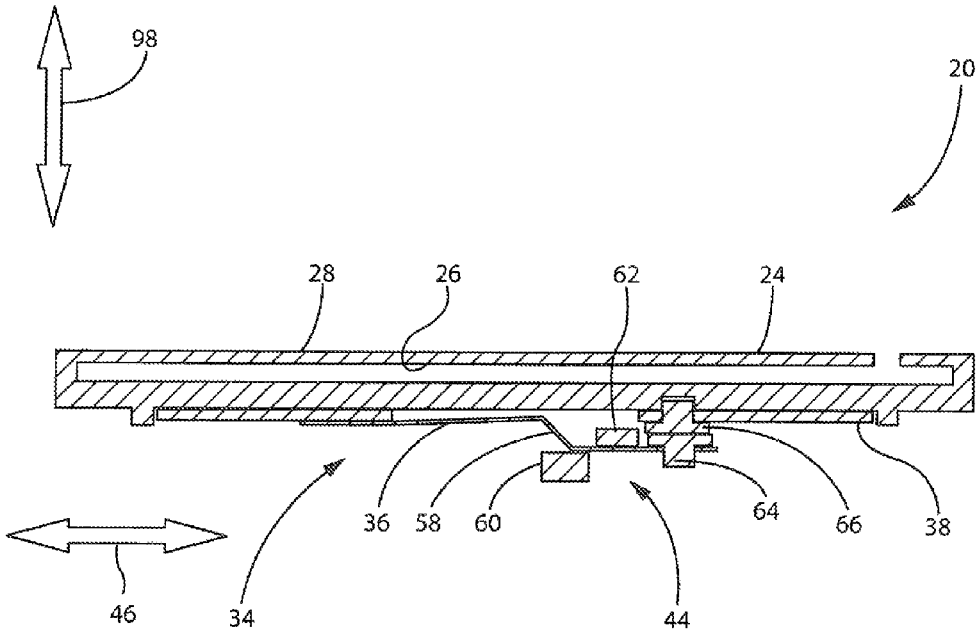
FIG. 6 is a top section view taken generally along line 6-6 in FIG. 5 with the electrical contact assembly in the closed position.

FIGS. 5 and 6 illustrate the baseplate 24 with the electrical contact assembly 34 where the actuator 44 has moved the electrical contact 64 towards the electrical contact 66. Particularly, the actuator 44 has been moved to the right so that the first ramp 60 biases the contract arms 36 and 40 at the angled step 58. Specifically, the first ramp 60 biases the contact arms 36 and 40 in the direction associated with arrows 98 so that the electrical contacts 64 and 66 are in electrical continuity with one another.

The remaining components and operation of the timer assembly 20 and the electrical contact assembly 34 are similar to those described above and any suitable changes may be made without departing from the spirit and scope of the present invention as one of ordinary skill in the art will immediately appreciate.

A thinner and more compact timer assembly can be utilized by implementing various features of the present invention, including but not limited to, recessed contact arm channels, contact arms positioned wholly on a single side, contact arms oriented with a length parallel to the baseplate 24 and a thickness parallel with the baseplate thickness, and a slim profile actuator which moves in the direction of the length of the contact arm.

Figure 7:
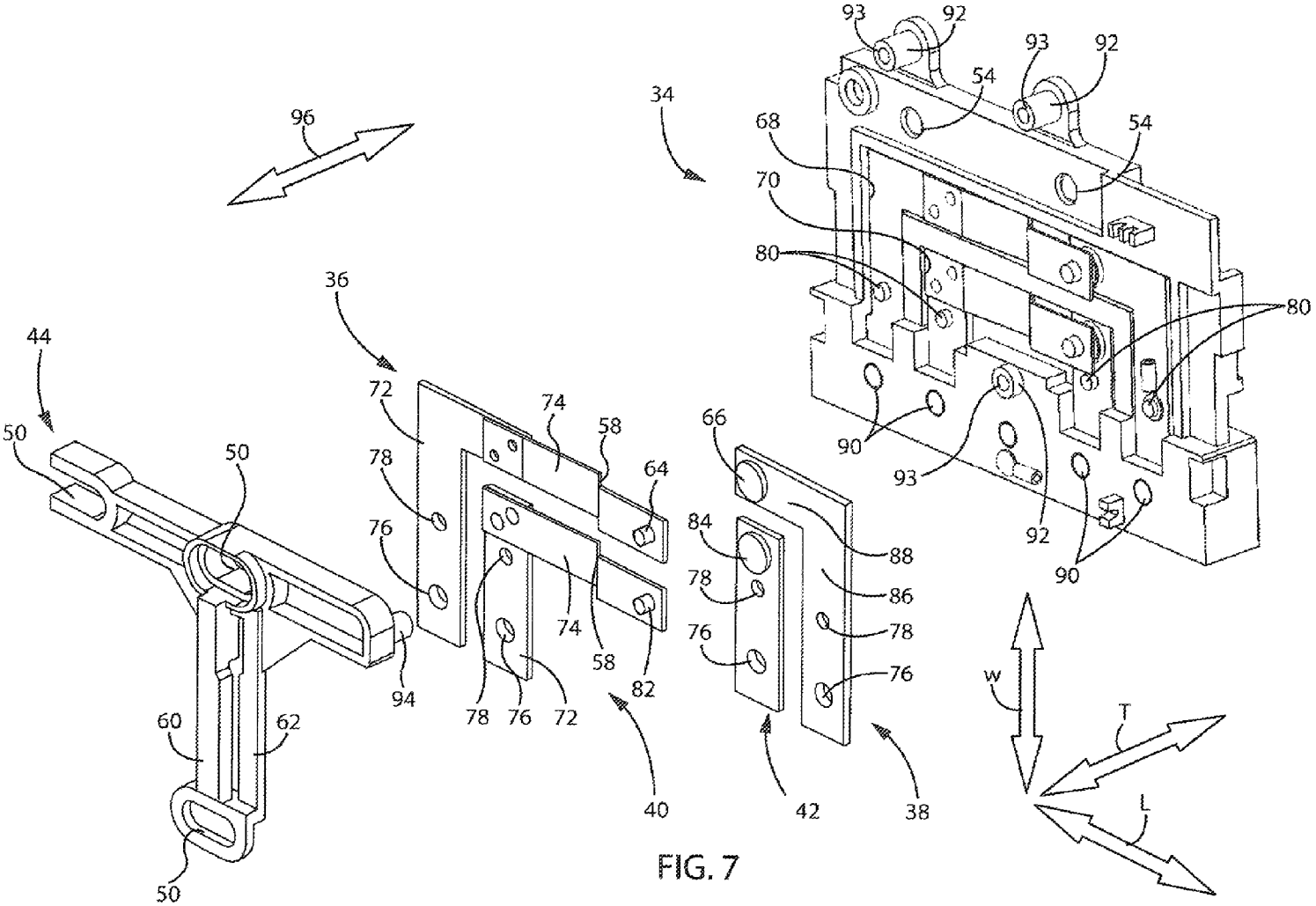
FIG. 7 is an exploded rear isometric view of the electrical contact assembly separated from the baseplate of the timer assembly.
Figure 8:
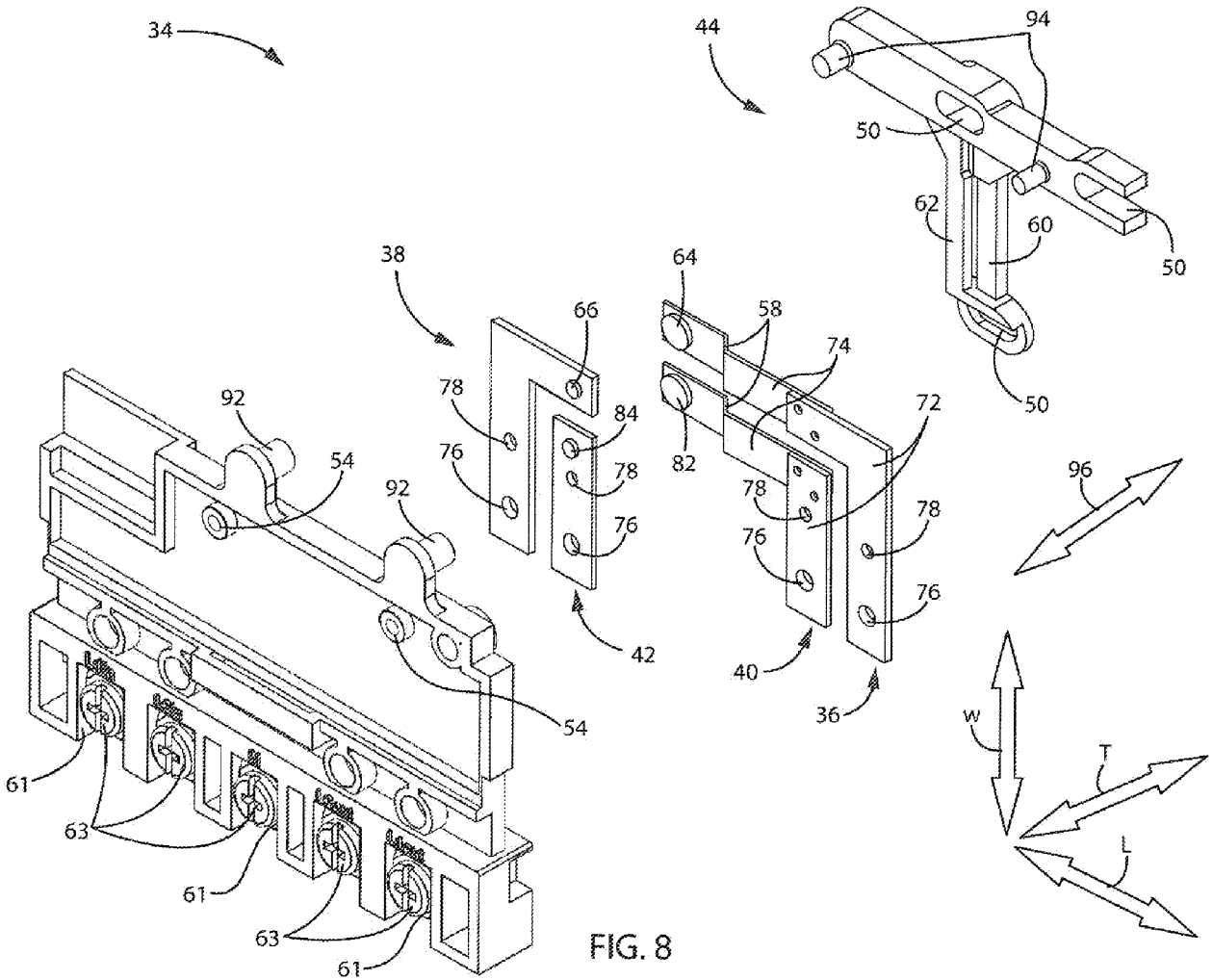
FIG. 8 is an exploded front isometric view of the electrical contact assembly separated from the baseplate of the timer assembly.
Figure 9:
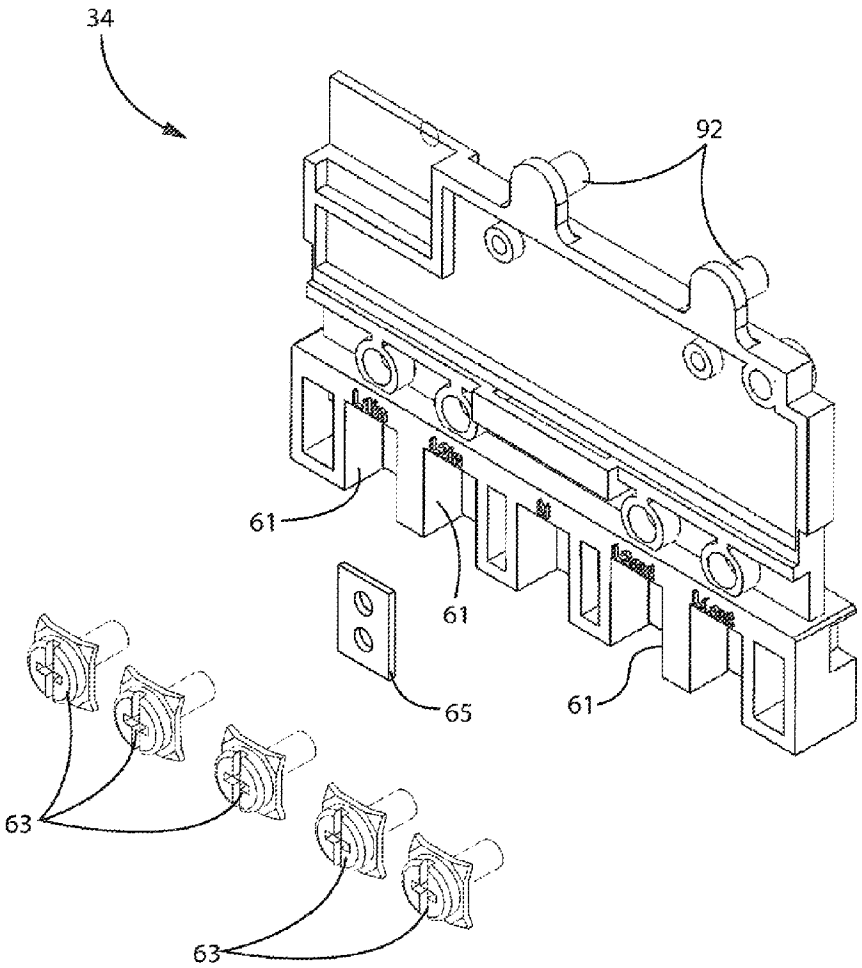
FIG. 9 is an exploded front isometric view of a section of FIG. 8 with a number of screws removed from the electrical contact assembly.

FIGS. 7 through 9 illustrate various exploded perspective views of the electrical contact assembly 34. The first contact arm 36 and the second contact arm 40 may be positioned on a left side, and the third contact arm 38 and the fourth contact arm 42 may be positioned on a right side. The contact arms 36, 38, 40, 42 are each positioned within the arm channels 68 and 70 as may be appropriate. Specifically, the first contact arm 36 and the third contact arm 38 may be positioned within arm channel 68, while the second contact arm 40 and the fourth contact arm 42 may be positioned within arm channel 70. Advantageously, arm channels 68 and 70 assist to further reduce the overall depth or thickness of the electrical contact assembly 34 by utilizing space in the assembly which would otherwise be wasted, and moves the contact arms closer to the front side 28 of the baseplate 24 and the electrical contact assembly.

First contact arm 36 and second contact arm 40 each include a first portion 72 and a second portion 74. In one aspect, the first portion 72 and the second portion 74 are oriented generally perpendicular to one another, with the second portion 74 having an angled step 58 as discussed above. The first portion 72 may include a threaded portion or hole 76 for receiving wiring screws 63 and providing electrical continuity between the wiring screws 63 and the first contact arm 36 first portion 72, or the second contact arm 40 first portion 72, as may be appropriate. Further, an alignment opening 78 may be located in the first portion 72 for aligning the first portion within arm channels 68 or 70 as may be appropriate and receiving an alignment tab 80 within the alignment opening 78. In another implementation, the alignment opening 78 may be located adjacent or proximate threaded hole 76 to ensure that the threaded hole 76 can receive screws 63. The first and second portions of the first contact arm 36 and the second contact arm 40 may be welded or physically connected together in any other suitable way so long as electrical continuity exists between the respective first and second portions.

As discussed above, the first contact arm 36 includes the first electrical contact 64 arranged to selectively interact with the third electrical contact 66 on the third contact arm 38, while the second contact arm 40 includes a second electrical contact 82 arranged to selectively interact with a fourth electrical contact 84 on the fourth contact arm 42. Third contact arm 38 and fourth contact arm 42 each include a first portion 86 having a threaded portion or hole 76 structurally and functionally similar to the threaded holes 76 in the first and second contact arms 36, 40, respectively. Further, the first portions 86 also include an alignment opening 78 for receiving alignment tabs 80, again similar to the first and second contact arms, as discussed above. As can be seen in FIG. 7, the fourth contact arm 42 only includes a first portion and does not include a second portion 88 like that on the third contact arm 38 or the second portion 74 of the first and second contact arms. Nevertheless, it is within the spirit and scope of the present invention to incorporate only first portions on each contact arm, first and second portions on each contact arm, or a combination of both without departing from the present invention.

Referring to FIG. 7, the electrical contact assembly 34 includes a series of apertures 90 for receiving screws 52 prior to contacting the respective contact arms. The electrical contact assembly 34 may also include a series of protrusions 92 having a threaded opening 93 therein for receiving the mounting screws 48. Above, the mounting screws 48 were described as limiting travel of the actuator 44, and while this is true in some implementations, the protrusions 92 alone or in combination with the mounting screws 48 may also act to limit the travel of the actuator 44 from left to right and right to left. The actuator 44 may also include a pin 94 arranged to be pushed in the direction associated with arrow 96 when the timer assembly indicates that the connected device should be turned off and separates the contacts 64 and 66 as well as the contacts 82 and 84.

In one implementation, the first contact arm 36 and the second contact arm 40 each include a length L, a thickness T, and a width W. Generally, the length L of each contact arm is greater than the thickness T or the width W. The length L may be oriented generally parallel to the baseplate 24 and extend in a direction generally left and right. In this arrangement, the length L is positioned left to right with respect to the baseplate 24 and the electrical contact assembly 34, while the thickness T is oriented in a direction front to back with respect to the baseplate 24 and the electrical contact assembly 34, while the width is generally oriented from top to bottom of the baseplate 24 and the electrical contact assembly 34. Accordingly, the orientation of the an length of the contact being generally parallel to the baseplate 24 allows the thickness T to be similar to the thickness of the baseplate, which together provide for a thinner overall arrangement since the thickness and length are optimized to match a length and thickness of the baseplate 24.

In operation, the actuator 44 moves generally parallel to the length of the first and second contact arms (left and right on the baseplate) and ramps 60 and 62 move each of the first and second contact arms in a direction generally perpendicular to the length of the contact arm or in a direction generally parallel to the thickness of the contact antis. Specifically, the second ramp 62 biases the respective electrical contacts (64 or 82) away from the other electrical contacts (66 or 84) when the actuator is moved to the left (when viewing the back side of the base plate 24). In a similar fashion, the first ramp 60 biases the respective electrical contacts (64 or 82) towards the other electrical contacts (66 or 84) when the actuator 44 is moved to the right. Regardless of which ramp (60 or 62) contacts the first or third contacts arms (36 and 38), the ramp generally contacts the angled ramp 58 which assists in biasing the contact arms together or apart as may be appropriate. Thus, the electrical contact biasing directions are generally perpendicular to the length of the electrical contact arms and the width of the electrical contact arms.

While a number of suitable arrangements may be envisioned, the first, second, third, and fourth electrical contacts may include only a single portion, multiple portions, or any combination, so long as a thin and/or recessed orientation is retained. Further, the advantageous use of a threaded hole 76 in the electrical contact arms further assists to reduce the overall thickness of the timer assembly since the electrical contacts only need to be located on a single side of the baseplate. The angle and position of ramps 60 and 62 may be adjusted for the particular contact and electrical contact arm arrangement. The angle and location of the angled ramps 58 may likewise be modified to fit the particular application, so long as the electrical contacts are separated when the electrical contact arms are disengaged and the electrical contacts remain in electrical continuity when the electrical contact arms are engaged with one another.

The drawings and detailed description generally describe single or two-phase systems with single or double pole switches. As can be envisioned, the timer assembly is suitable for any number of electrical systems with various phase requirements, which are not limited to those shown or described, but instead only by the number of phases known to one skilled in the art. In the same manner, any suitable number of pole switches may be utilized with the timer assembly to achieve the results of a thinner timer assembly with a number of electrical contacts.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention

We claim:

1. A timer assembly comprising:

a baseplate having a front side and a back side;

a time indicator extending from the front side;

an electrical contact assembly supported on the back side of the base plate, wherein the electrical contact assembly includes at least one contact arm having a first contact, wherein the at least one contact arm defines a length longer than its width, and wherein the at least one contact arm is arranged such that the length of the at least one contact arm is generally parallel with the back side of the base plate;

a second contact supported on the back side of the base plate; and an actuator for selectively connecting and disconnecting the first and second contacts, wherein the actuator is movable in a direction generally parallel with the length of the at least one contact arm.

2. The timer assembly of claim 1 further comprising a second contact arm having a length longer than its width and a third contact on the second contact arm.

3. The timer assembly of claim 2 further comprising a fourth contact selectively separable from the third contact.

4. The timer assembly of claim 1 wherein the first and second contacts are in electrical continuity when the actuator is in a first position and are not in electrical continuity when the actuator is in a second position.

5. The timer assembly of claim 1 further comprising a protrusion extending from the electrical contact assembly, wherein the actuator movement is limited by the protrusion.

6. The timer assembly of claim 1 wherein the actuator moves to a left side and a right side of the baseplate.

7. The timer assembly of claim 1 wherein the at least one contact arm further comprises a threaded portion opposite the first contact for receiving a screw.

8. The timer assembly of claim 7 wherein the screw carries an electrical current there through.

9. The timer assembly of claim 7 wherein the at least one contact arm further comprises an alignment opening adjacent the threaded portion.

10. The timer assembly of claim 9 wherein the alignment opening is received on the electrical contact assembly.

11. The timer assembly of claim 1 wherein the timer assembly transmits an electrical phase selected from the group consisting of single phase, two-phase, and three phase.

12. A timer assembly comprising:

a baseplate having a front side and a back side;

a time indicator extending from the front side;

an electrical contact assembly supported on the back side of the base plate, wherein the electrical contact assembly includes at least one contact arm having a first contact, wherein the at least one contact arm defines a length longer than its width, and wherein the at least one contact arm is arranged such that the length of the at least one contact arm is generally parallel with the back side of the base plate;

a second contact supported on the back side of the base plate; and an actuator for selectively connecting and disconnecting the first and second contacts, wherein the actuator moves one of the first and second contacts in a direction transverse to the length of the at least one contact arm.

13. The timer assembly of claim 12 wherein the at least one contact arm includes an angled step and wherein the actuator moves the at least one contact arm at the angled step.

14. A timer assembly comprising:

a baseplate having a front side and a back side;

a time indicator extending from the front side;

an electrical contact assembly supported on the back side of the base plate, wherein the electrical contact assembly includes at least one contact arm having a first contact, wherein the at least one contact arm defines a length longer than its width, and wherein the at least one contact arm is arranged such that the length of the at least one contact arm is generally parallel with the back side of the base plate;

a second contact supported on the back side of the base plate; and an actuator for selectively connecting and disconnecting the first and second contacts, wherein the actuator includes a pair of ramps, and wherein the at least one contact arm is positioned between the pair of ramps.

15. The timer assembly of claim 14 wherein one of the pair of ramps moves the at least one contact arm in a first direction.

16. The timer assembly of claim 15 wherein the other of the pair of ramps moves the at least one contact arm in a second direction opposite the first direction.

17. A timer assembly comprising:

a baseplate having a front side and a back side;

a time indicator extending from the front side;

an electrical contact assembly having a first contact arm having a length longer than its width and a first contact on the first contact arm;

a second contact arm having a length longer than its width and a second contact on the second contact arm;

a third contact arm having a third contact;

a fourth contact arm having a fourth contact; and a movable actuator that acts on the first and second contact arms, wherein the actuator is movable in a direction parallel to the first and second contact arm lengths;

wherein movement of the actuator causes the first contact to selectively engage the third contact and the second contact to selectively engage the fourth contact.

18. The timer assembly of claim 17 wherein the first and second contact arms each further comprise an angled step.

19. The timer assembly of claim 18 wherein the actuator contacts the angled steps.

20. The timer assembly of claim 17 wherein the first and second contact arms each further comprise a threaded portion arranged to conduct electrical current therein.

21. The timer assembly of claim 17 wherein the first and second contact arms do not extend to the front side of the baseplate.

22. A timer assembly comprising:

a baseplate having a front side and a back side;

a time indicator extending from the front side;

an electrical contact assembly having a first contact arm having a length longer than its width and a first contact on the first contact arm;

a second contact arm having a length longer than its width and a second contact on the second contact arm;

a third contact arm having a third contact;

a fourth contact arm having a fourth contact; and a movable actuator that acts on the first and second contact arms, wherein the actuator is movable in a direction parallel to the first and second contact arm lengths;

wherein movement of the actuator causes the first contact to selectively engage the third contact and the second contact to selectively engage the fourth contact, and wherein the actuator moves the first and third contacts in a direction perpendicular to the direction of actuator movement.

23. The timer assembly of claim 22 wherein the actuator further comprises a pair of ramps for moving the first and second contact arms.

24. The timer assembly of claim 23 wherein one of the pair of ramps moves the first and second contact arms in a first direction and the other of the pair of ramps moves the first and second contact arms in a second direction.

* * * * *